US005897307A

United States Patent [19]

Chang

[11] Patent Number: 5,897,307

[45] Date of Patent: Apr. 27, 1999

[54] DISPOSABLE LIGHTER HAVING A SAFETY FUNCTION OF PREVENTING UNWANTED IGNITION

[76] Inventor: Ming Yu Chang, 2240 E. Washington Blvd., Los Angeles, Calif. 90021

[21] Appl. No.: 08/881,848

[22] Filed: Jun. 24, 1997

[51] Int. Cl.[6] ..... F23D 11/36

[52] U.S. Cl. ..... 431/153; 431/273; 431/277

[58] Field of Search ..... 431/277, 153, 431/274, 276, 255, 271

[56] References Cited

U.S. PATENT DOCUMENTS

| | | | |
|---|---|---|---|
| 5,096,414 | 3/1992 | Zellweger | 431/277 |
| 5,364,261 | 11/1994 | Huang | 431/277 |
| 5,597,299 | 1/1997 | Jon | 431/277 |
| 5,676,537 | 10/1997 | Fang | 431/277 |
| 5,788,474 | 8/1998 | Chung et al. | 431/277 |

*Primary Examiner*—James C. Yeung
*Attorney, Agent, or Firm*—David and Raymond; Raymond Y. Chan

[57] ABSTRACT

A disposable lighter having a safety function for preventing unwanted ignition, which eliminates the two driving wheels provided in conventional gas lighter and renders a radius of a striking wheel approximately equal to a curved corner formed at a top end corner of each wing portion of a wind shield so as to sidewardly cover the striking wheel. Therefore, the disposable lighter may only be ignited by the user's thumb on purpose that can prevent the striking wheel from being rubbed with any object to accidentally ignite. Moreover, an underage kid is also unable to ignite the disposable lighter without any adult supervision by preventing the striking wheel be stuck by a minor's thumb.

12 Claims, 6 Drawing Sheets

DISPOSABLE LIGHTER HAVING A SAFETY FUNCTION OF PREVENTING UNWANTED IGNITION

FIELD OF THE INVENTION

The present relates to a gas lighter, and more particularly to a disposable lighter having a safety function of preventing unwanted ignition which can only be ignited by the user's thumb on purpose and prevent the striking wheel thereof from being rubbed with any object to accidentally ignite.

BACKGROUND OF THE PRESENT INVENTION

Today, almost every common household own at least a couple of gas lighters for fire lighting conveniences. Disposable gas lighters have always been well recognized as convenient and inexpensive lighting gadgets. It is small and handy and a smooth thumb strike against the striking wheel may simply ignite and light-up.

As shown in FIG. 1, a traditional disposable gas lighter is illustrated, which comprises a lighter body 1 to receive liquefied fuel, a mounting frame 2 sealedly equipped on top of the lighter body 1, a gas lever 3 which is accessibly attached between a first and a second vertical supporting tower 4, 5, having a central cutout 6 allowing the pass through of a spring chamber head 7, wherein the gas lever 3 is adapted to shift a gas nozzle 8 to release gas from the interior of the lighter body 1 via a gas valve 9, and an ignition device comprising a spring A1 entirely received inside the spring chamber head 7, a flint A2 supporting on top of the spring A1 and having a bottom portion inserted into the spring chamber head 7, and a striking wheel A31 rotatably mounted between the first and second vertical supporting towers 4, 5 which comprises an striking wheel A31 and two driving wheels A32, A33 coaxially disposed on two sides of the striking wheel A31 respectively, and a U-shaped wind shield is mounted on the mounting frame 2 to cover the gas nozzle 8 and the ignition device A3. The flint A2 must be upwardly pressed against the striking wheel A31. The two driving wheels A32, A33 are integrally engaged with the smaller striking wheel A31 so that when the two driving wheels A32, A33 are struck to rotate by a user, the striking wheel A31 will be driven to rotate simultaneously by the two driving wheel A32, A33 to strike against the flint A2 to generate spark for igniting the gas released from the gas nozzle 8 when the gas lever 3 is downwardly pushed by the user.

To those cigarette smokers and countryside travelers, such traditional disposable gas lighter is one of the necessities to be carrier in the user's pocket or baggage. However, in order to facilitate the igniting operation, the top portions of the two driving wheels A32, A33 are arranged protruding upwardly from the wind shield A4 thereof and in free and easy rotating manner that even a slight and smooth rotation of the two driving wheels A32, A33 will drive the striking wheel A31 to successfully strike on the flint A2 provided underneath to ignite and generate flame. It is extremely dangerous if the two driving wheel A32, A33 are accidentally rubbed by object, unwanted flame will be ignited to burn the user's pocket or baggage.

Another big concern of such traditional fire lighting gadgets is that, it may fall into a hand of an underage minor who is unfamiliar with the safety of the gadget, but yet focusing on the fun of spark igniting.

Over the recent years, fire accidents have destroyed thousands of families, it burned down many homes and business buildings. As we know fire is one of the mother nature's great element that destroy without any mercy. Local communities tried very hard to enforce selling gas lighters to any underage minor, but somehow a gas lighter just seems to fall into a minor's hand and usually the adults discover it after an accident occurred.

Out in the market today, there are a numerous types of safety gas lighters being manufactured and distributed, but these conventional gas lighters utilize complicate safety switches and safety hiding triggers which may largely increase the number of parts and the manufacturing cost and labor.

SUMMARY OF THE PRESENT INVENTION

The main object of the present invention is to provide a disposable lighter having a safety function of preventing unwanted ignition, which can only be ignited by the user's thumb on purpose and can prevent the striking wheel thereof from being rubbed with any object to accidentally ignite.

Another object of the present invention is to provide a disposable lighter having a safety function of preventing unwanted ignition, to which underage kids are unable to ignite without any adult supervision by preventing the striking wheel be struck by a minor's thumb.

Accordingly, the present invention provides a disposable lighter which comprises a lighter body, a mounting frame, a flint, a gas lever, a gas valve, an ignition device, and a U-shaped wind shield.

The lighter body is used for receiving a liquefied fuel therein. The mounting frame, which is sealedly affixed on top of the lighter body, comprises a first and a second supporting wall integrally, parallelly, vertically, and upwardly extended from two sides of the mounting frame, the mounting frame further having a vertical spring chamber between the first and second supporting walls. The flint spring is received in the spring chamber. The gas lever is pivotally mounted between the first and second supporting walls and has a central cutout to allow the spring penetrating therethrough to insert into the spring chamber. The gas lever further integrally provides a thumb pusher at one end thereof. The gas valve with a gas nozzle extending upwards above the mounting frame is installed inside the mounting frame. The gas nozzle is engaged with another end of the gas lever, so that when the thumb pusher is pushed downwardly, the another end of the gas lever lifts the gas nozzle to release gas from an interior of the lighter body via the gas valve.

The ignition device comprises a flint and a striking wheel, wherein the flint is supported on top of the flint spring with a bottom portion thereof inserting into the spring chamber. The striking wheel which has a circumferential coarse striking surface is positioned right above the flint by rotatably mounting between the first and second supporting walls, so that the flint is pressed downwardly by the circumferential coarse striking surface of the striking wheel, and that the flint is relatively pressed by the flint spring upwards to urge against the circumferential coarse striking surface of the striking wheel, the circumferential coarse striking surface having a width slightly larger than a diameter of the flint.

The U-shaped wind shield is mounted on the first and second supporting walls to cover the gas nozzle and the first and second supporting walls. The wind shield has an all around vertical U-shaped side wall which has a round end portion and two wing portion extending from the round end portion, a top wall horizontally and inwardly extending from a top side of the round end portion of the U-shaped side wall and defining a cutout right above the gas nozzle, and a first and a second L-shaped bent-edge member which are respectively and perpendicularly bent from a top side and an end side of the wing portions. The first and second bent-edge members are respectively extended from the top wall along the top side and the end side of each of the wing portions for fittedly and respectively resting on a horizontal top edge and a vertical rear edge of each of the first and second supporting walls. A top end corner of each of the wing portions forming a curved corner which has a curvature matching with a quarter of a circumference of the striking wheel, so that the striking wheel is sidewardly covered by the two wing portions of the windshield.

Moreover, the two bent-edge members of the wind shield are respectively and inwardly extended until abutting two sides of the striking wheel to form two protecting bent-edge members in order to cover two gaps formed between the striking wheel and the first and second supporting walls for better striking contact by increasing a contact area with a user's thumb. The striking wheel further comprises two circular discs integrally formed at the two sides of the striking wheel, each of the circular discs having a glossy circumferential surface and a width equal to each of the two gaps formed between the first and second supporting walls and the striking wheel. Each of the circular discs has a diameter equal to that of the striking wheel.

Alternatively, each of the circular disc may has a diameter smaller than that of the striking wheel to form a supporting disc.

In an alterative mode, the striking wheel further comprises two circular discs integrally formed at the two sides of the striking wheel, each of the circular discs having a glossy circumferential surface and a width equal to two gaps formed between the first and second supporting walls and the striking wheel, the circular discs each having a diameter equal to that of the striking wheel so as to fill the two gaps respectively.

DETAILED DESCRIPTION OF THE PREFERRED EMBODIMENT

Figure 2:
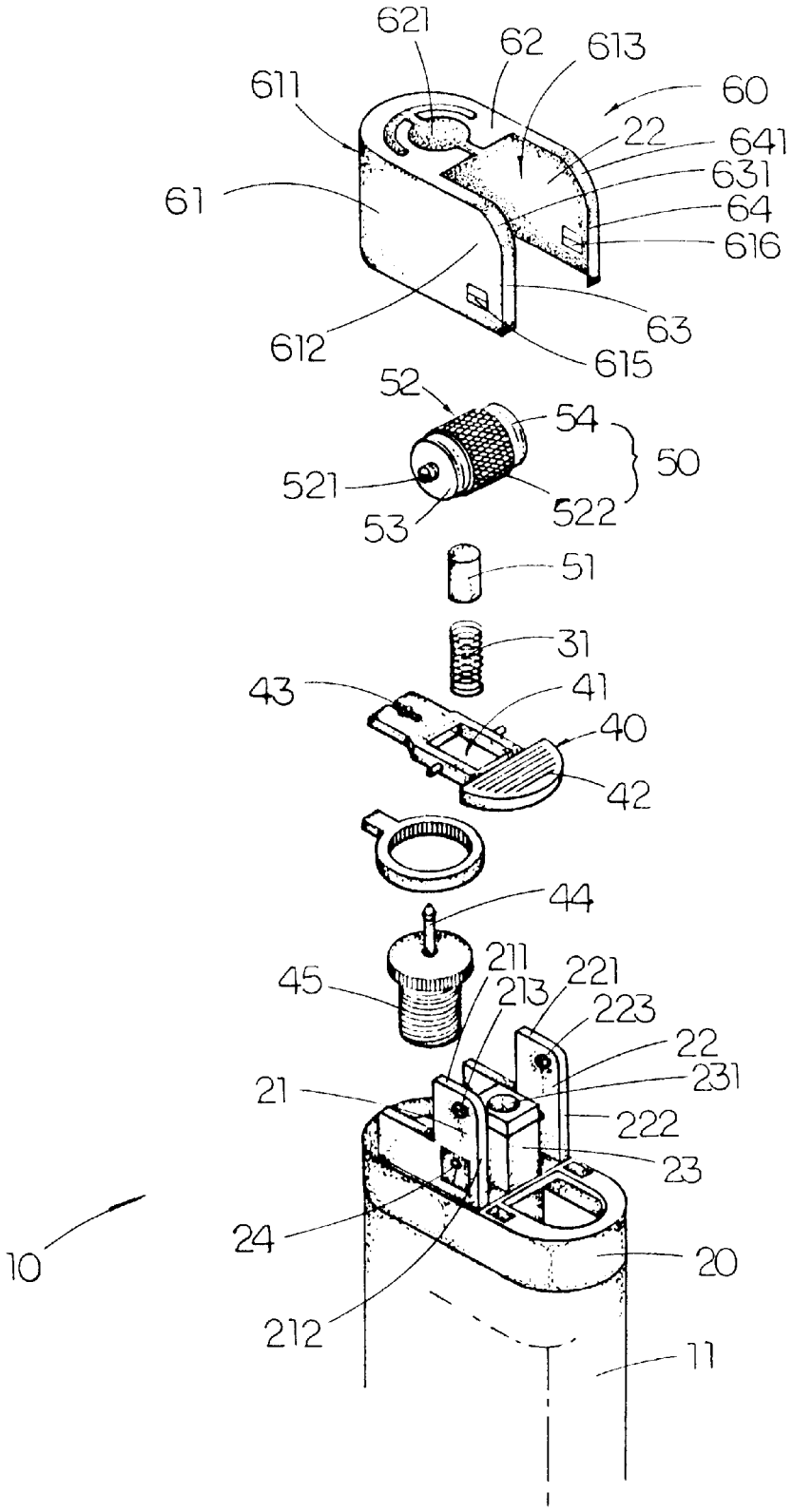
FIG. 2 Is an exploded perspective view of a disposable lighter according to a first preferred embodiment of the present invention.
Figure 3:
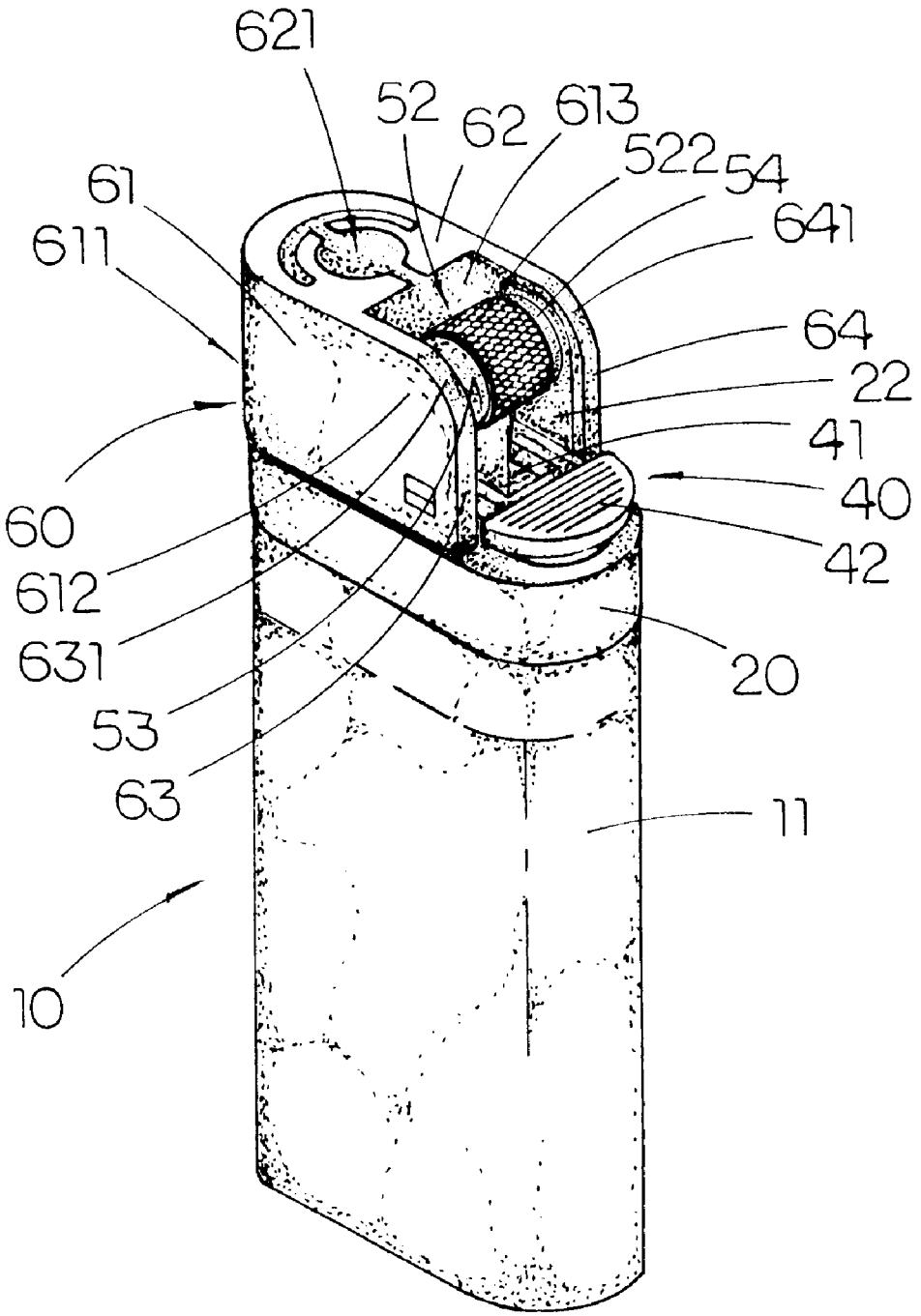
FIG. 3 is perspective view of the disposable lighter according to the above first preferred embodiment of the present invention.
Figure 4:
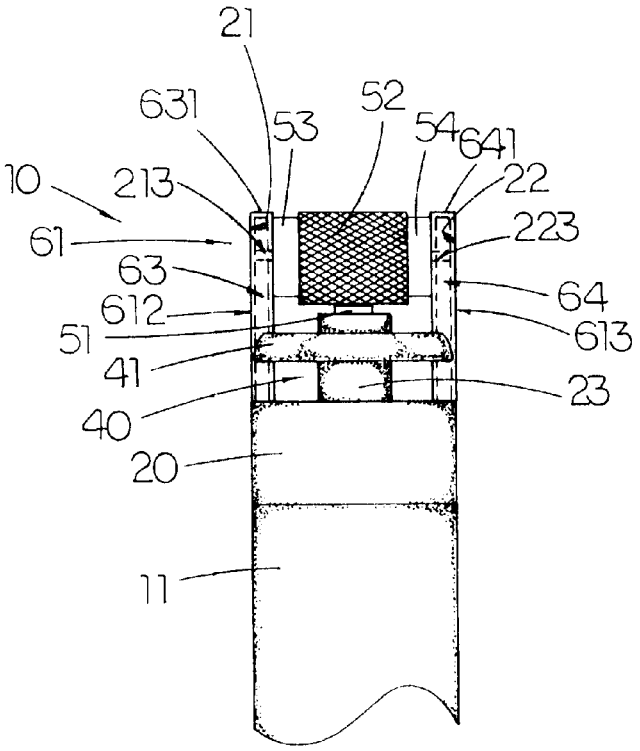
FIG. 4 is a partial end view of the disposable lighter according to the above first preferred embodiment of the present invention, showing the relationship between the wind shield and the striking wheel after assembled.

Referring to FIGS. 2 to 4 of the drawings, a disposable lighter having a safety device to prevent unwanted ignition according to a first preferred embodiment of the present invention is illustrated. The disposable lighter 10 comprises a lighter body 11 to receive liquefied fuel therein, a mounting frame 20 which is sealedly affixed on top of the lighter body 11 comprising a first and a second supporting wall 21, 22 integrally, parallelly, vertically, and upwardly extended from two sides of the mounting frame 20. The mounting frame 20 further comprises a spring chamber head 23, which is upwardly protruded between the first and second supporting walls 21, 22 and has a height shorter than the heights of the first and second supporting walls 21, 22. A circular spring chamber 231 is formed longitudinally and axially in the spring chamber head 23 to receive a flint spring 31 therein.

The disposable lighter 10 further comprises a gas lever 40 which has a central cutout 41 to allow the spring chamber head 23 to pass therethrough when the gas lever 40 is pivotally mounted between the first and second supporting walls 21, 22. The gas lever 40 has one end integrally provided with a thumb pusher 42 and another end forming a lifting hole 43 engaged with a gas nozzle 44, which is connected on a gas valve 45 installed inside the mounting frame 20. When the thumb pusher 42 is pushed down, the gas lever 40 will lift up the gas nozzle 44 to release gas from an interior of the lighter body 11 via the gas valve 45.

The disposable lighter further comprises an ignition device 50 which comprises a flint 51 and a striking wheel 52, wherein the flint is supported on top of the flint spring 31 with a bottom portion inserting into the spring chamber 231, so that a top end of the flint 51 is pressed by the flint spring 31 to urge against the striking wheel.

The disposable lighter further comprises a U-shaped wind shield 60 molded from a piece of thin metal, which is mounted on the first and second supporting walls 21, 22 to cover the gas nozzle 44 and the ignition device 50. The wind shield 60 has an all around vertical U-shaped side wall 61, a top wall 62 horizontally and inwardly extending from a top side of a round end portion 611 of the U-shaped side wall 61 and defining a cutout 621 right above the gas nozzle to allow an ignited flame burning the fuel gas emitted from the gas nozzle 44 to extend upwardly therethrough. A first and a second L-shaped bent-edge member 63, 64 are respectively and perpendicularly bent from a top side and an end side of each of two wing portions 612, 613 of the U-shaped side wall 61, wherein the two bent-edge members 63, 64 are respectively extended from the top wall 62 along the top side and the end side of each wing portion 612, 613 for fittedly and respectively resting on a horizontal top edge 211, 221 and a vertical rear edge 212, 222 of each of the first and second supporting walls 21, 22 of the mounting frame 20. On a root portion of each of the first and second supporting walls 21, 22, an engaging recess 24 is formed thereon to engage with an inwardly punched indention 616, 615 of each wing portion 612, 613 of the U-shaped side wall 61 in order to firmly mount the wind shield 60 in position on the mounting frame 20, as shown in FIGS. 2 and 3.

Figure 1:
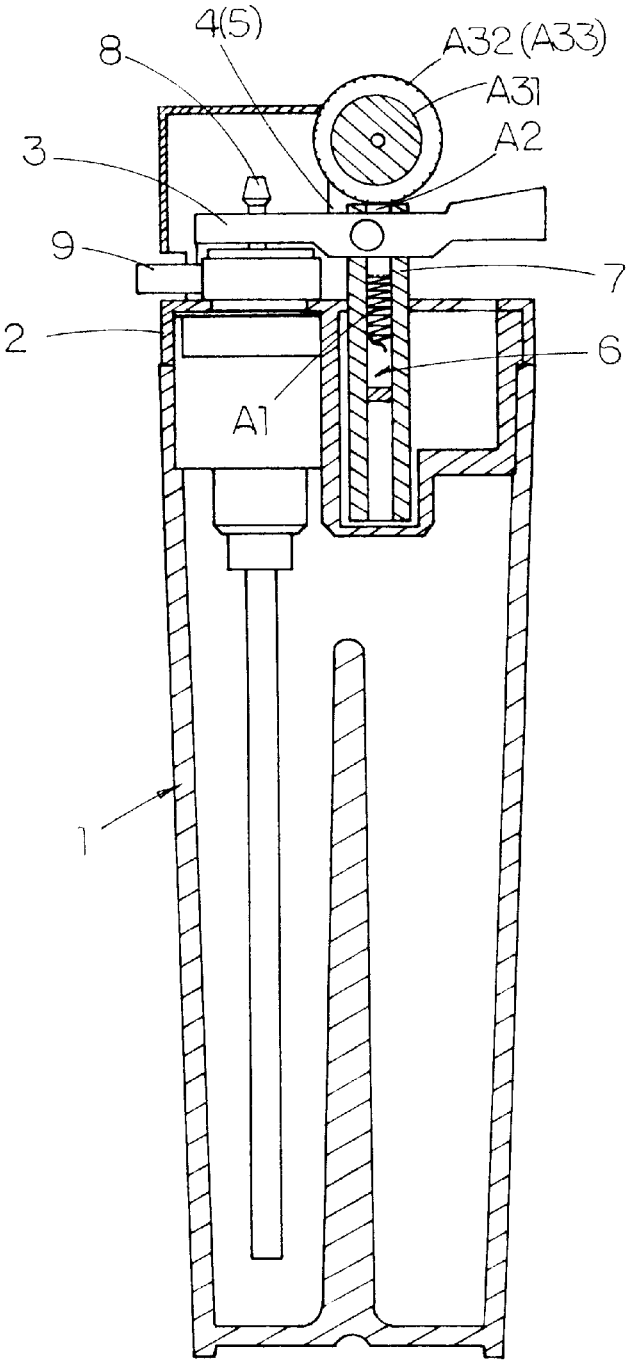
FIG. 1 PRIOR ART
FIG. 1 is a sectional view of a traditional gas lighter.

In accordance with the first preferred embodiment of the present invention, the two driving wheel A32, A33 of the conventional gas lighter as shown in FIG. 1 are eliminated. As shown in FIG. 2, the striking wheel 52 has an wheel axle 521 coaxially extending from two sides thereof to respectively insert into two supporting holes 213, 223 for rotatably supporting the striking wheel 52 in position and compressing the bottom portion of the flint 51 into the spring chamber 231, wherein the whole flint spring 31 is compressed inside the spring chamber 231 to provide an upwards urging force to press the flint 51 against the striking wheel 52.

A coarse striking surface 522 must be provided on the circumference of the striking wheel 52 in order to provide spark toward the gas nozzle 44 to ignite the fuel gas emitted therefrom when the striking surface 522 is rubbed against the flint 51 by rotating the striking wheel 52. Basically, since the finishing cost of the circumferential coarse striking surface 522 of the striking wheel is relatively high, the width of the striking wheel 52 should be minimized to slightly larger than a diameter of the flint 51 and the spring chamber 231 so as to save as much as manufacturing cost as possible. Moreover, a top end corner of each wing portion 612, 613 forms a curved corner 631, 641 which has a curvature matching with a quarter of circumference of the striking wheel 52, i.e. a radius of the striking wheel 52 should be approximately equal to or slightly less than a radius of each of the curved corners 631, 641. Therefore, as shown in FIGS. 3 and 4, after the striking wheel 52 is rotatably mounted between the first and second supporting walls 21, 22, the circumference of the striking wheel 52 should not exceed a boundary of the wind shield 60. As shown in FIG. 4, one can observe that the height of a top side of the striking wheel 52 is approximately equal to the height of the wind shield 60.

In order to fill the gaps between two sides of the striking wheel 52 and the two bent-edge members 63, 64 and to provide a better striking contact with an adult's thumb by increasing the contacting area, two circular discs 53, 54, each having a glossy circumferential surface and a diameter approximately equal to that of the striking wheel 52, are integrally formed at the two sides of the striking wheel 52. The two circular discs 53, 54 and the striking wheel 52 can be made of a single cylindrical metal rod by elongating the length of the striking wheel 52 and only providing the circumferential coarse striking surface 522 at the central portion thereof. However, it is also practical to integrally affix two independent circular discs 53, 54 in the proximity of the two sides of the striking wheel 52 to form an one-body configuration.

Accordingly, the striking wheel 52 of the disposable lighter of the present invention is arranged to match the curvature of the curved corners 631, 641 of the wind shield 60. In other words, the striking wheel 52 is protected by the wind shield 60 also, so that the striking wheel 52 can only be ignited by the user's thumb on purpose and can prevent the striking wheel 52 from being rubbed with any object to accidentally ignite. Furthermore, in the past, an underage kid can easily ignite a conventional gas lighter by rubbing the protruding driving wheel A32, A33, as shown in FIG. 1, with limited force. However, the underage kid is prevented to ignite the present invention since his or her weak minor's thumb force is unable to apply a sufficient striking force to the striking wheel 52 of the present invention without any adult supervision.

Figure 7:
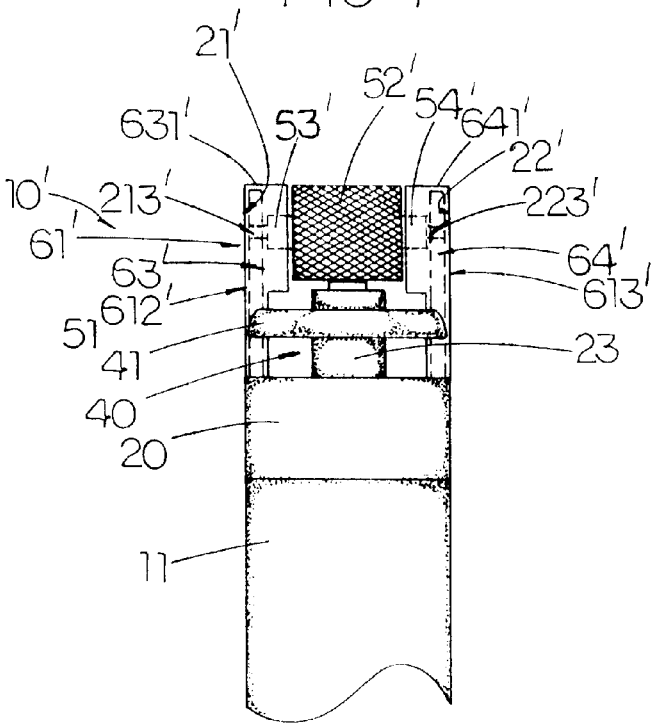
FIG. 7 is a partial end view of the disposable lighter according to the above second preferred embodiment of the present invention, showing the relationship between the wind shield and the striking wheel after assembled.
Figure 5:
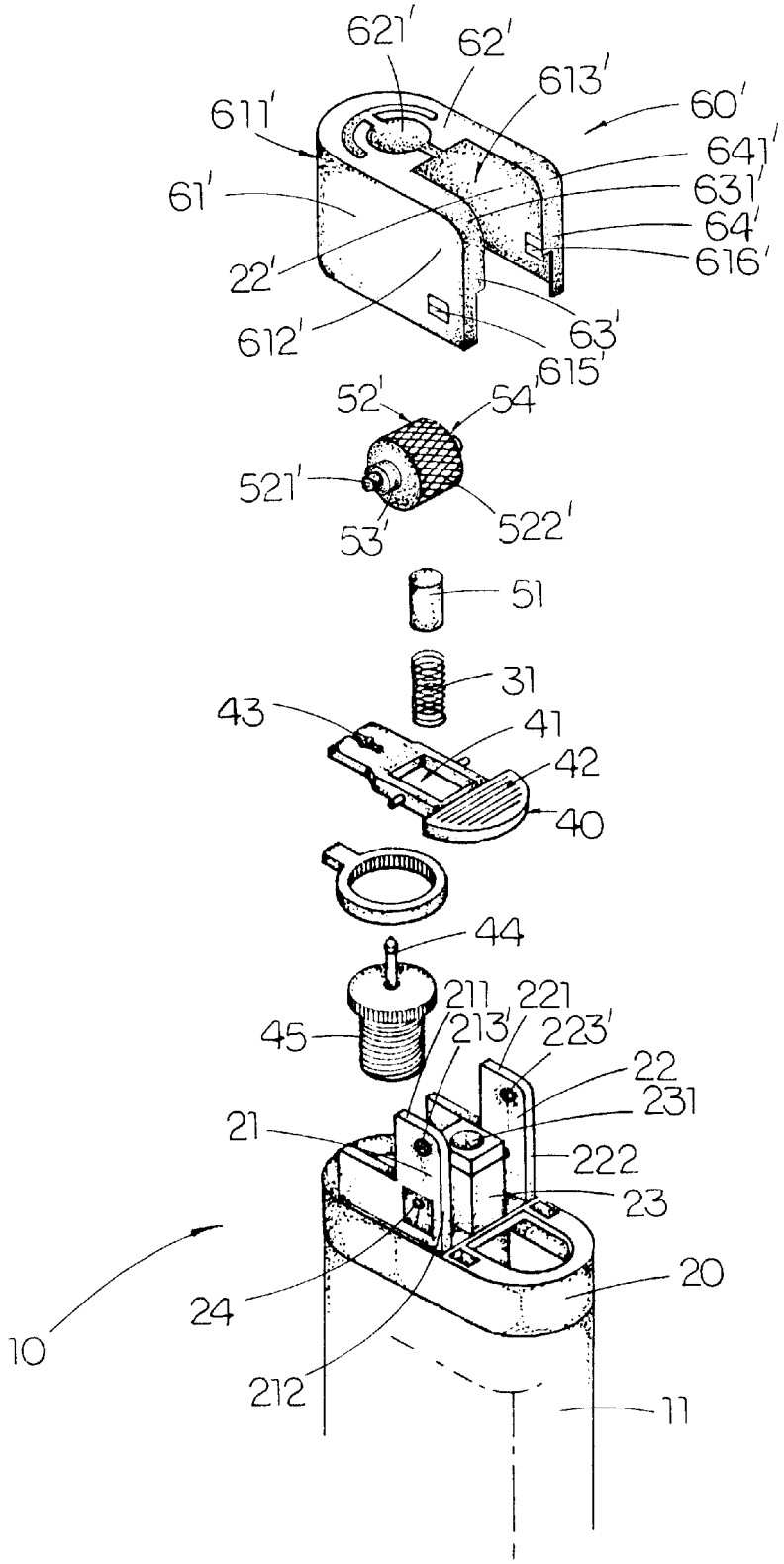
FIG. 5 is an exploded perspective view of an alternative mode of the disposable lighter according to a second preferred embodiment of the present invention.
Figure 6:
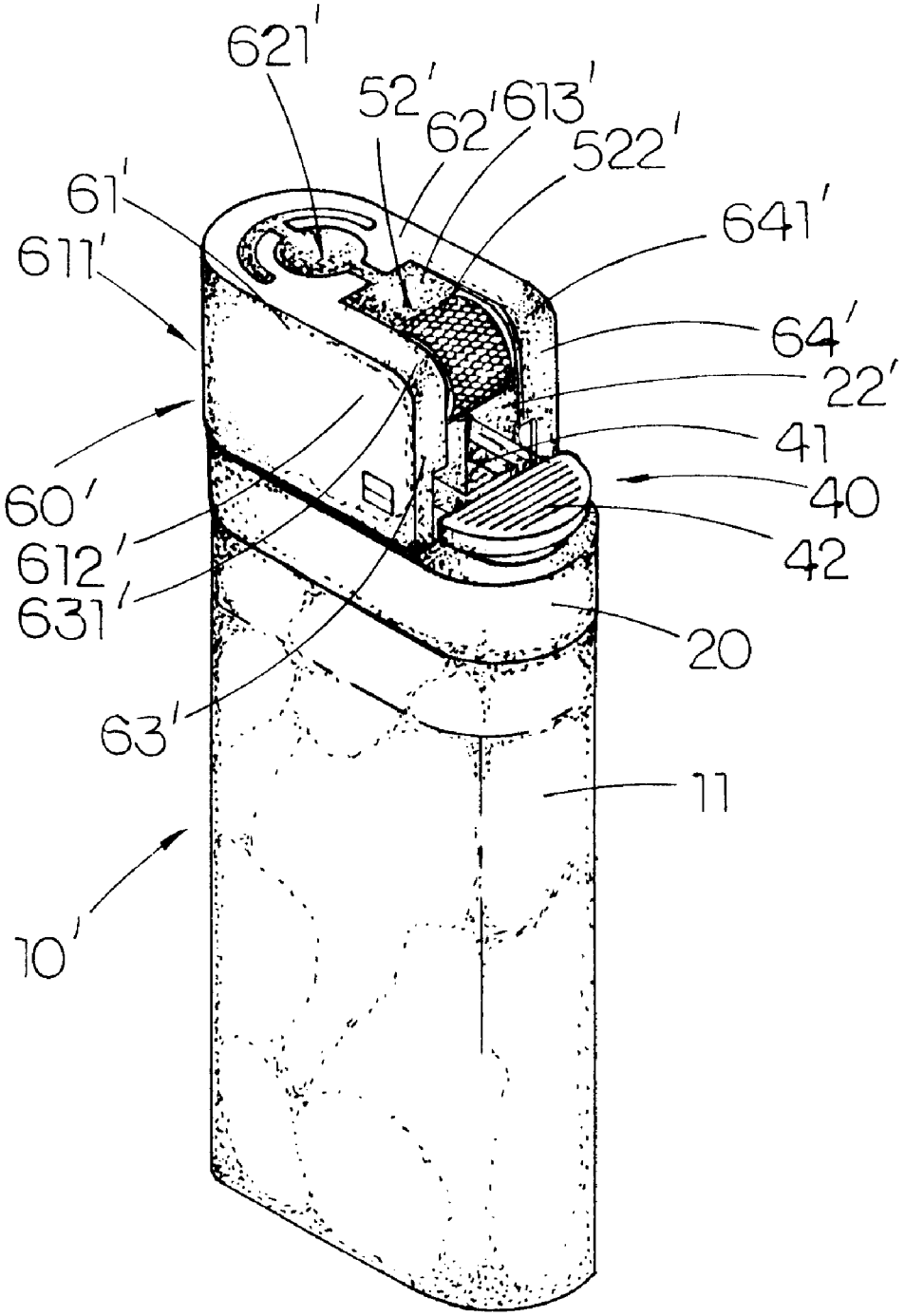
FIG. 6 is a perspective view of the disposable lighter according to the above second preferred embodiment of the present invention.

Referring to FIGS. 5 to 7, a second preferred embodiment of the present invention which is an alternative mode of the above first embodiment is illustrated, wherein the disposable lighter 10' basically has an identical configuration with the above first embodiment except the striking wheel 52' and the wind shield 60'. According to this second preferred embodiment, the gaps between two sides of the striking wheel 52 and the two bent-edge members 63, 64 are filled by a first and a second protecting bent-edge member 63', 64' of the wind shield 60.

The U-shaped wind shield 60 of the second preferred embodiment is also molded from a piece of thin metal, which is mounted on the mounting frame 20 to cover the gas nozzle 44 and the ignition device 50. The wind shield 60' also has an all around vertical U-shaped side wall 61', a top wall 62' horizontally and inwardly extending from a top side of a round end portion 611 ' of the U-shaped side wall 61' and defining a cutout 621' to allow an ignited flame burning the fuel gas emitted from the gas nozzle 44 to extend upwardly therethrough. The first and the second L-shaped protecting bent-edge member 63', 64' are respectively and perpendicularly bent from a top side and an end side of each of two wing portion 612', 613' of the U-shaped side wall 61', wherein the two protecting bent-edge members 63', 64' are respectively extended from the top wall 62' along the top side and the end side of each wing portion 612', 613' for fittedly and respectively resting on a horizontal top edge 211, 221 and a vertical rear edge 212, 222 of each of the first and second supporting walls 21, 22 of the mounting frame 20. On a root portion of each of the first and second supporting walls 21, 22, an engaging recess 24 is formed thereon to engage with an inwardly punched indention 616', 615' of each wing portion 612', 613' of the U-shaped side wall 61' in order to firmly mount the wind shield 60' in position on the mounting frame 20', as shown in FIGS. 5 and 6. Furthermore, the two protecting bent-edge members 63', 64' are respectively and inwardly extended until abutting to the two sides of the striking wheel 52 so as to cover the axle 521' as well as two circular discs 53', 54' protruding from the two sides of the striking wheel 52.

The striking wheel 52' is also rotatably mounted between the first and second supporting walls 21, 22 by inserting two ends of the axle 521' to the two supporting holes 213', 223' provided on the first and second supporting walls 21', 22' respectively. The striking wheel 52' also has a coarse striking surface 522' which must be provided on the circumference of the striking wheel 52' in order to provide spark toward the gas nozzle 44 to ignite the fuel gas emitted therefrom when the striking surface 522' is rubbed against the flint 51 by rotating the striking wheel 52'.

In this second embodiment, the width of the striking wheel 52' is also minimized to reduce the finishing cost of the circumferential coarse striking surface 522' of the striking wheel'. Similarly, a top end corner of each wing portion 612', 613' forms a curved corner 631', 641 ' which has a curvature matching with a quarter of circumference of the strike wheel 52', that is a radius of the striking wheel 52' is approximately equal to or slightly less than a radius of each of the curved corners 631', 641'. Therefore, as shown in FIGS. 6 and 7, the circumference of the striking wheel 52' should not exceed a boundary of the wind shield 60'. As shown in FIG. 7, the height of a top side of the striking wheel 52' is approximately equal to the height of the wind shield 60'.

Since the two protecting bent-edge members 63', 64' are inwardly extended to increase their width until abutting to the two sides of the striking wheel 52', the two circular discs 53', 54' can thus be reduced their diameters symmetrically for further decreasing the manufacturing cost and reinforcing the axle 521'. Of course, the striking wheel 52 in the first embodiment is also able to be utilized in this second embodiment, wherein the two circular discs 53, 54 are arranged to be covered by the two protecting bent-edge members 63', 64' respectively.

The two protecting bent-edge members 63', 64' similarly provide two glossy surfaces in the proximity of the circumferential coarse striking surface 522' so as to ensure the effect of increasing contact surface area with the user's thumb for better striking feeling. According to this second preferred embodiment, the disposable lighter 10' can only be ignited by the user's thumb on purpose and can prevent the striking wheel thereof from being rubbed with any object to accidentally ignite. Besides, the underage kids are also unable to ignite the disposable lighter 10' without any adult supervision by preventing the striking wheel be struck by an minor's thumb.

What is claimed is:

1. A disposable lighter, comprising:

a lighter body for receiving a liquefied fuel therein;

a mounting frame, which is sealedly affixed on top of said lighter body, comprising a first and a second supporting wall integrally, parallelly, vertically, and upwardly extended from two sides of said mounting frame, said mounting frame further having a vertical spring chamber between said first and second supporting walls;

a flint spring being received in said spring chamber;

a gas lever being pivotally mounted between said first and second supporting walls and having a central cutout to allow said spring penetrating therethrough to insert into said spring chamber, said gas lever further integrally providing a thumb pusher at one end thereof;

a gas valve with a gas nozzle extending upwards above said mounting frame being installed inside said mounting frame, said gas nozzle being engaged with another end of said gas lever, so that when said thumb pusher is pushed downwardly, said another end of said gas lever lifts said gas nozzle to release gas from an interior of said lighter body via said gas valve;

an ignition device comprising a flint and a striking wheel, wherein said flint is supported on top of said flint spring with a bottom portion thereof inserting into said spring chamber, said striking wheel which has a circumferential coarse striking surface being positioned right above said flint by rotatably mounting between said first and second supporting walls, so that said flint is pressed downwardly by said circumferential coarse striking surface of said striking wheel, and that said flint is relatively pressed by said flint spring upwards to urge against said circumferential coarse striking surface of said striking wheel, said circumferential coarse striking surface having a width slightly larger than a diameter of said flint, wherein said striking wheel further comprises two circular discs integrally formed at said two sides of said striking wheel, each of said circular discs having a glossy circumferential surface and a width equal to each of said two gaps formed between said first and second supporting walls and said striking wheel; and a U-shaped wind shield mounted on said first and second supporting walls to cover said gas nozzle and said first and second supporting walls, said wind shield having an all around vertical U-shaped side wall which has a round end portion and two wing portion extending from said round end portion, a top wall horizontally and inwardly extending from a top side of said round end portion of said U-shaped side wall and defining a cutout right above said gas nozzle, and a first and a second L-shaped bent-edge member which are respectively and perpendicularly bent from a top side and an end side of said wing portions, wherein said first and second bent-edge members are respectively extended from said top wall along said top side and said end side of each of said wing portions for fittedly and respectively resting on a horizontal top edge and a vertical rear edge of each of said first and second supporting walls, a top end corner of each of said wing portions forming a curved corner which has a curvature matching with at least a quarter of a circumference of said striking wheel, so that said striking wheel is sidewardly covered by said two wing portions of said windshield, wherein said first and second bent-edge members of said wind shield are respectively and inwardly extended until abutting two sides of said striking wheel to form two protecting bent-edge members in order to cover two gaps formed between said striking wheel and said first and second supporting walls for better striking contact by increasing a contact area with a user's thumb.

2. A disposable lighter, as recited in claim 1, wherein each of said circular discs has a diameter equal to that of said striking wheel.

3. A disposable lighter, as recited in claim 1, wherein each of said circular disc has a diameter smaller than that of said striking wheel to form a supporting disc.

4. A disposable lighter, as recited in claim 1, wherein a radius of said striking wheel is equal to a radius of said curved corner of each of said wing portions of said wind shield.

5. A disposable lighter, as recited in claim 2, wherein a radius of said striking wheel is equal to a radius of said curved corner of each of said wing portions of said wind shield.

6. A disposable lighter, as recited in claim 3, wherein a radius of said striking wheel is equal to a radius of said curved corner of each of said wing portions of said wind shield.

7. A disposable lighter, as recited in claim 1, wherein a radius of said striking wheel is slightly smaller than a radius of said curved corner of each of said wing portions of said wind shield.

8. A disposable lighter, as recited in claim 2, wherein a radius of said striking wheel is slightly smaller than a radius of said curved corner of each of said wing portions of said wind shield.

9. A disposable lighter, as recited in claim 3, wherein a radius of said striking wheel is slightly smaller than a radius of said curved corner of each of said wing portions of said wind shield.

10. A disposable lighter, comprising:

a lighter body for receiving a liquefied fuel therein;

a mounting frame, which is sealedly affixed on top of said lighter body, comprising a first and a second supporting wall integrally, parallelly, vertically, and upwardly extended from two sides of said mounting frame, said mounting frame further having a vertical spring chamber between said first and second supporting walls;

a flint spring being received in said spring chamber;

a gas lever being pivotally mounted between said first and second supporting walls and having a central cutout to allow said spring penetrating therethrough to insert into said spring chamber, said gas lever further integrally providing a thumb pusher at one end thereof;

a gas valve with a gas nozzle extending upwards above said mounting frame being installed inside said mounting frame, said gas nozzle being engaged with another end of said gas lever, so that when said thumb pusher is pushed downwardly, said another end of said gas lever lifts said gas nozzle to release gas from an interior of said lighter body via said gas valve;

an ignition device comprising a flint and a striking wheel, wherein said flint is supported on top of said flint spring with a bottom portion thereof inserting into said spring chamber, said striking wheel which has a circumferential coarse striking surface being positioned right above said flint by rotatably mounting between said first and second supporting walls, so that said flint is pressed downwardly by said circumferential coarse striking surface of said striking wheel, and that said flint is relatively pressed by said flint spring upwards to urge against said circumferential coarse striking surface of said striking wheel, said circumferential coarse striking surface having a width slightly larger than a diameter of said flint, wherein said striking wheel further comprises two circular discs integrally formed at said two sides of said striking wheel, each of said circular discs having a glossy circumferential surface and a width equal to two gaps formed between said first and second supporting walls and said striking wheel, said circular discs each having a diameter equal to that of said striking wheel so as to fill said two gaps respectively; and a U-shaped wind shield mounted on said first and second supporting walls to cover said gas nozzle and said first and second supporting walls, said wind shield having an all around vertical U-shaped side wall which has a round end portion and two wing portion extending from said round end portion, a top wall horizontally and inwardly extending from a top side of said round end portion of said U-shaped side wall and defining a cutout right above said gas nozzle, and a first and a second L-shaped bent-edge member which are respectively and perpendicularly bent from a top side and an end side of said wing portions, wherein said first and second bent-edge members are respectively extended from said top wall along said top side and said end side of each of said wing portions for fittedly and respectively resting on a horizontal top edge and a vertical rear edge of each of said first and second supporting walls, a top end corner of each of said wing portions forming a curved corner which has a curvature matching with at least a quarter of a circumference of said striking wheel, so that said striking wheel is sidewardly covered by said two wing portions of said windshield.

11. A disposable lighter, as recited in claim 10, wherein a radius of said striking wheel is equal to a radius of said curved corner of each of said wing portions of said wind shield.

12. A disposable lighter, as recited in claim 10, wherein a radius of said striking wheel is slightly smaller than a radius of said curved corner of each of said wing portions of said wind shield.

* * * * *